United States Patent [19]

Kadunce

[11] Patent Number: 4,471,900

[45] Date of Patent: Sep. 18, 1984

[54] COMPOSITE CONTAINER CONSTRUCTION FOR PACKAGING MATERIALS UNDER PRESSURE OR VACUUM CONDITIONS

[75] Inventor: Leo Kadunce, Morrisville, Pa.

[73] Assignee: Steeltin Can Corporation, Baltimore, Md.

[21] Appl. No.: 430,383

[22] Filed: Sep. 30, 1982

[51] Int. Cl.[3] ..... B65D 3/00; B65D 8/04

[52] U.S. Cl. ..... 229/4.5; 220/67; 220/450; 220/458; 229/5.5; 428/35

[58] Field of Search ..... 220/67, 73; 229/4.5; 428/35

[56] References Cited

U.S. PATENT DOCUMENTS

| | | | |
|---|---|---|---|
| 2,719,662 | 10/1955 | Minteer et al. | 229/4.5 |
| 2,857,076 | 10/1958 | Tolbert, Jr. et al. | 220/67 |
| 2,901,162 | 8/1959 | Vallas | 229/4.5 |
| 3,224,659 | 12/1965 | Goodwin, Jr. | 229/4.5 |
| 3,298,589 | 1/1967 | Angstadt | 220/73 |
| 3,322,046 | 5/1967 | Hall . | |
| 3,891,135 | 6/1975 | Szatkowski . | |

*Primary Examiner*—William R. Dixon, Jr.
*Attorney, Agent, or Firm*—Cushman, Darby & Cushman

[57] ABSTRACT

A container is formed by providing a composite wall with reinforcing strips which surround the exterior of the wall at its opposite ends. The container is capped by end closures the edges of which engage the reinforcing strips to deform the strips to both overlap the closure edges and compress the container wall between the strips and the closures.

11 Claims, 7 Drawing Figures

COMPOSITE CONTAINER CONSTRUCTION FOR PACKAGING MATERIALS UNDER PRESSURE OR VACUUM CONDITIONScl BACKGROUND OF THE INVENTION

The present invention relates to an improved composite container construction capable of retaining goods packaged under either vacuum or pressure conditions. Although the invention may be utilized in embodiments wherein the basic component of the container wall is either a polymeric or a fibrous material, the invention is particularly suited to applications in which the container wall is a composite fiber construction. Accordingly, the discussion to follow will be directed primarily to such an embodiment.

A composite fiber container wall principally is formed from fibrous materials (such as kraft, chip or jute paper) and therefore requires that the inner surface of the container be completely sealed and that the metal closures on its opposite ends be tightly locked in sealing relationship onto the container. Additionally, the container must be capable of easy opening.

Present methods of manufacturing composite fiber container bodies involve convolute or spiral winding techniques so as to form a tube. The materials used in forming spiral wound and convolute tubing are pliable by nature and therefore are susceptible to displacement and fracturing under pressure or vacuum conditions. For this reason, either immediate leakage occurs due to fracturing of the container body, or eventual slow leakage results from a process known in the industry as "creep". In the latter case, the metal end closures tend to work their way loose from the container over a period of time.

Because of such problems, composite containers have not been suitable for certain markets where the product is packaged under pressure or vacuum conditions. Examples of such products are tennis balls, coffee, nuts, low pressure aerosols, and the like.

SUMMARY OF THE INVENTION

According to the present invention, a pressure or vacuum-type composite container is produced by providing a reinforcing strip to the cut edges at opposite ends of the container. Such strips preferably are a metallic material which can be flanged. These strips are made integral with the container by being applied as bands to the composite tubing prior to its being cut into container lengths. The bands are spaced along the tubing at the points where it is cut so that each end of a container includes a strip of a reinforcement band. After the cutting operation, the reinforcing strips are flanged so as to be adapted to receive metallic end closures.

To seal a container end, the edge of the closure is rolled into interlocking relationship with the flanged reinforcing strip. As a result, the edge of the container is compressed between the rigid reinforcing strip and the end closure, causing it to act as a gasket. At the same time, the metal-to-metal contact between the reinforcing strip and the closure effectively eliminates "creep". By this procedure, sufficient strength is imparted to the container construction to permit the use of standard can openers to open the container.

DETAILED DESCRIPTION OF THE INVENTION

The invention now will be described in greater detail with respect to the accompanying drawings wherein.

Figure 1:
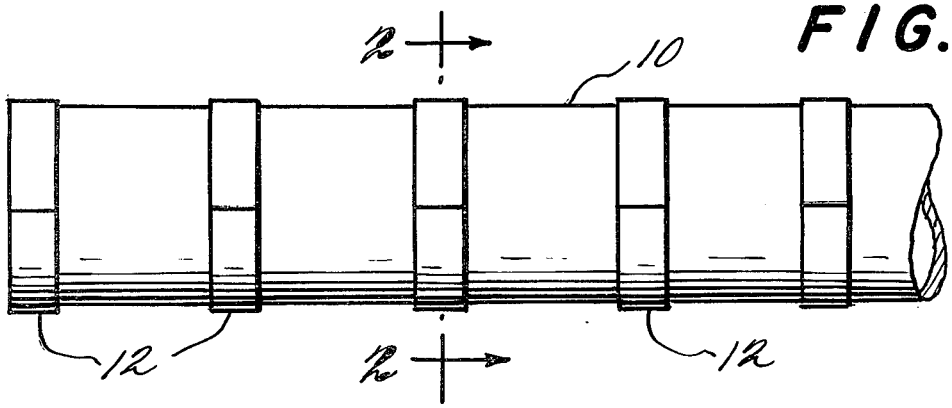
FIG. 1 is an elevational view of a segment of composite tubing with metal reinforcing bands bonded at spaced locations to its outer surface.

Referring to the drawings, FIG. 1 illustrates a length of composite fiber tubing 10 provided with metallic reinforcing bands 12 integrally secured to the tubing at spaced locations along its length. The spacing of the bands corresponds to the desired lengths of the containers which are formed by cutting the tubing along the circumferential centerlines of the bands.

Figure 2:
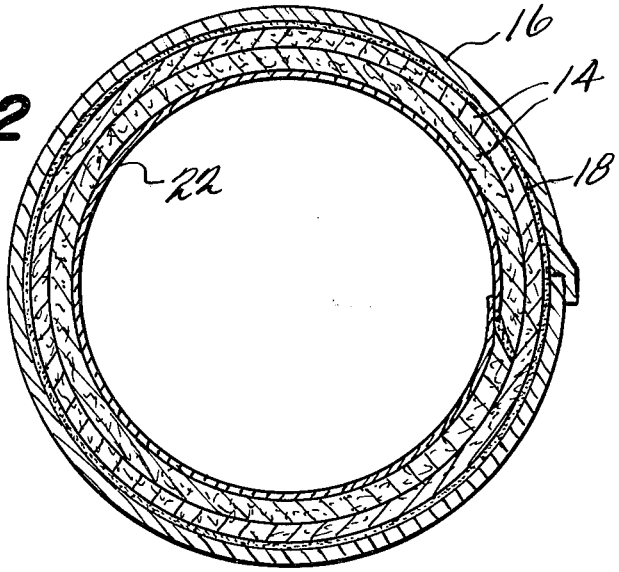
FIG. 2 is an enlarged sectional view taken along line 2—2 of FIG. 1.
Figure 3:
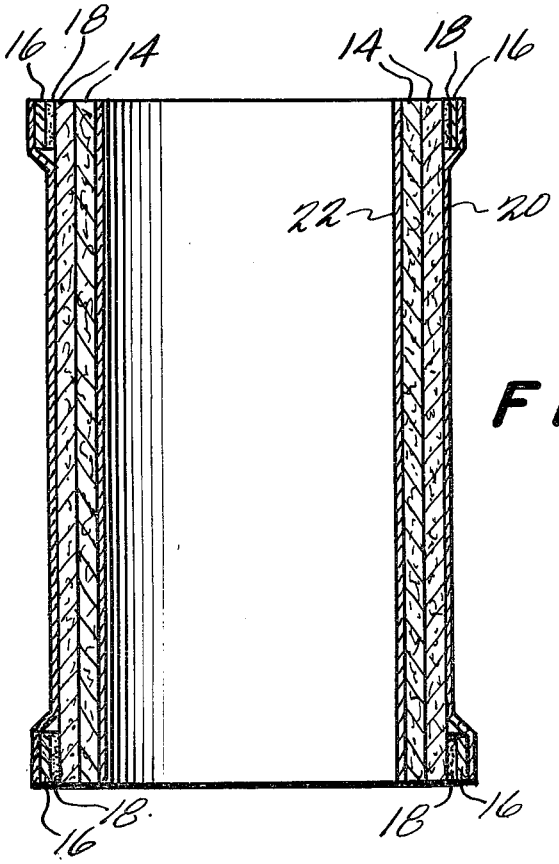
FIG. 3 is an enlarged sectional view of a portion of the tubing shown in FIG. 1 cut to container length.
Figure 4:
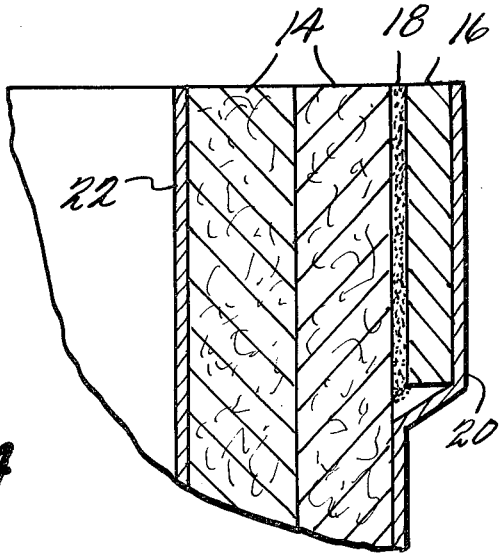
FIG. 4 is an enlarged sectional view of a segment of the tubing shown in FIG. 3.

Details of a container body can be appreciated by reference to FIGS. 2–4. The container includes a multiply composite fiber wall 14 having strips 16 of the reinforcing bands 12 at its opposite ends. These strips are securely bonded to the outer surface of wall 10 by a suitable adhesive 18.

The outer surface of the container can be labeled prior to the affixing of the reinforcing bands 12 or after installation of the strips, as indicated by the numeral 20 in FIGS. 3 and 4.

To seal the interior wall of the container, a lining 22 (illustrated in FIGS. 2–4) is employed which typically comprises a barrier layer of material having a low moisture or vapor transmission rate, such as metallic foils, wax and synthetic polymers. The lining 22 is suitably laminated or adhered to the exposed surface of the innermost composite fiber ply 14.

Figure 5:
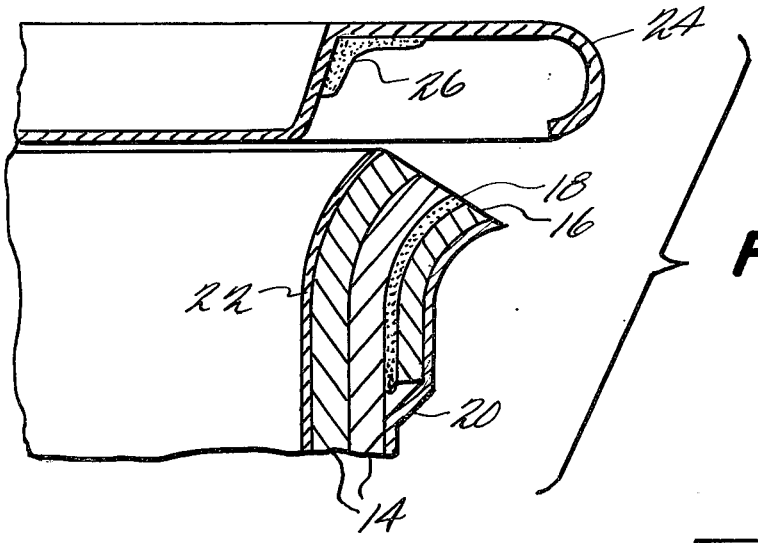
FIG. 5 is an exploded sectional view of a portion of a metal end closure and its relationship to the segment of tubing shown in FIG. 4 after the latter has been flanged to receive the closure.
Figure 7:
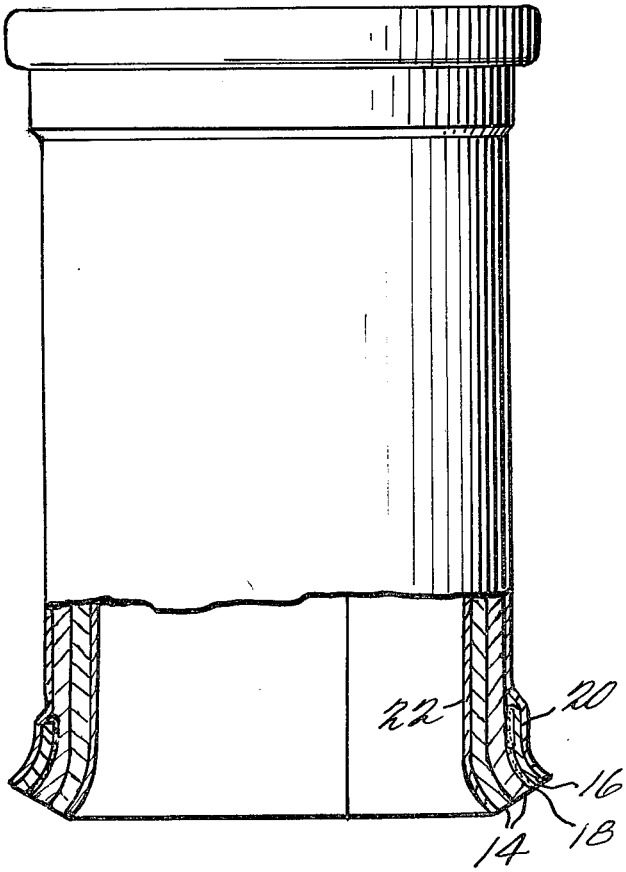
FIG. 7 is an elevational view partially in section, illustrating a completed container prior to its being filled.

After the tubing 10 has been cut into lengths to form container bodies, the opposite ends of each body are flanged, as shown in FIGS. 5 and 7. The flanged portions fan out where the tubing 10 has been cut, much like the pages of an opened book, with the reinforcing strip 16 being at the outer edge of the flange. If desired, heat may be applied to the cut edges of the tubing to soften the reinforcing strips 16 and bonding agent 18 to facilitate the flanging operation.

Figure 6:
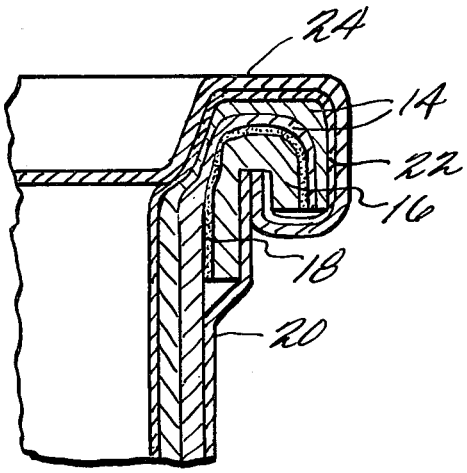
FIG. 6 is a sectional view illustrating the interlocking relationship created between the portion of metal end closure and the segment of tubing shown in FIG. 5 after they are brought together into operative relationship.

Once the flanges have been formed, metal end closures can be seated on the container bodies and interlocked with the reinforcing strips 16 by a conventional can seamer. More particularly, a closure 24 is placed over the end of a container body (FIG. 5) so that its edge overlaps the flange. The closure then is rolled into contact with the flange such that the edge of the closure pierces label 20 and engages the reinforcing strip 16. Further rolling by the can seamer results in additional deformation of the closure edge and the flange to produce a locking action with the closure 24 in metal-to-metal contact with strip 16 (FIG. 6). The interlocking of closure 24 and strip 16 produced by the seaming process, and the firm anchoring of strip 16 to container wall 14, results in the anchoring of closure 24 to the container.

As is apparent in FIG. 6, after the seaming operation, the multi-ply wall 14 and liner 22 are compressed between reinforcing strip 16 and the end closure 24 so as to form an air-tight sealing gasket. To further improve the seal, a suitable sealant material 26 may be applied to the end closure 24 prior to placing the closure in engagement with the flange at the end of the container body (FIG. 5).

The container as it appears just prior to filling is shown in FIG. 7. After it is filled, the entire container is sealed by applying a further end closure in the same manner as previously described.

The support provided by the reinforcing strip 16 is the factor that enables the interior of the container to be maintained pressurized or partially evacuated through secure sealing of the end closures 24 to the container. This holds true regardless of whether the composite fiber wall construction is spirally or convolutely wound, provided the following conditions are met:

(1) that the reinforcing strips are of a material having suitable strength and rigidity characteristics;

(2) that the strips are placed so that the flanged wall portions of the container are compressed between the reinforcing strips and the end closures; and (3) that the deformation of the reinforcing strips so as to contact and overlap the edges of the closure is sufficient to prevent what is known as "creep".

By reinforcing the container wall with a reinforcing strip, the seam formed when the end closure is secured to the container is given additional strength, thereby helping to support the seam when it is opened by a conventional can opener which uses a serrated wheel that rides along the seam to drive the cutting blade. The reinforcing strip also lends additional support to the container wall directly adjacent the seam.

It should be noted that by reinforcing the flanged edge of the container wall, the flange is sufficiently supported to resist breakdown when moistened, as often occurs during liquid fill operations.

While the preferred embodiment of the invention has been described with respect to a composite fiber container, it will be understood that the invention also may be incorporated in a container construction in which the composite wall is a material suitably lined with an impervious metallic or plastic foil.

What is claimed is:

1. A container construction comprising:

a composite wall;

a metallic reinforcing strip secured to and surrounding the exterior of the wall at each end thereof;

closures at the ends of the wall for sealing the container, said end closures each having an edge which engages a corresponding reinforcing strip and which deforms both the strip and a portion of the wall adjacent the strip such that an edge of the strip overlaps the closure edge in interlocking relationship and the deformed portion of the wall is compressed between said strip edge and the closure.

2. A container construction as set forth in claim 1 wherein both the reinforcing strips and the end closures are metallic whereby a metal-to-metal sealing relationship is achieved by engagement of the edges of the closures with the reinforcing strips.

3. A container construction as set forth in either of claims 1 or 2, wherein said wall comprises:

a barrier layer of substantially moisture- and vapor-impervious material lining the interior of said wall.

4. A container construction as set forth in claim 3, wherein said wall comprises multiple plies of fiber.

5. A container construction as set forth in claim 3, wherein said wall comprises a polymeric material.

6. A container construction as set forth in either of claims 1 or 2, wherein said wall comprises multiple plies of fiber.

7. A container construction as set forth in either of claims 1 or 2, wherein said wall comprises a polymeric material.

8. A container construction as set forth in either of claims 1 or 2, further comprising:

additional sealant means interposed between said wall and the end closures.

9. A container construction as set forth in claim 8, wherein said wall comprises:

a barrier layer of substantially moisture- and vapor-impervious material lining the interior of said wall.

10. A container construction as set forth in claim 8, wherein said wall comprises multiple plies of fiber.

11. A container construction as set forth in claim 8, wherein said wall comprises a polymeric material.

* * * * *